US008092276B2

(12) United States Patent
Maumus et al.

(10) Patent No.: US 8,092,276 B2
(45) Date of Patent: Jan. 10, 2012

(54) METHOD OF FABRICATING A PART MADE UP OF A PLURALITY OF THIN-WALLED TUBES AND HAVING A SURFACE OF REVOLUTION

(75) Inventors: Jean-Pierre Maumus, Saint Medard en Jalles (FR); Rémi Bessette, Tresses (FR)

(73) Assignee: SNECMA Propulsion Solide, Le Haillan (FR)

( * ) Notice: Subject to any disclaimer, the term of this patent is extended or adjusted under 35 U.S.C. 154(b) by 531 days.

(21) Appl. No.: 12/330,711

(22) Filed: Dec. 9, 2008

(65) Prior Publication Data

US 2009/0149116 A1 Jun. 11, 2009

(30) Foreign Application Priority Data

Dec. 10, 2007 (FR) ..... 07 59678

(51) Int. Cl.
*B24C 1/04* (2006.01)

(52) U.S. Cl. ..... 451/40; 451/39

(58) Field of Classification Search ..... 451/38, 451/39, 40, 4; 83/53, 177
See application file for complete search history.

(56) References Cited

U.S. PATENT DOCUMENTS

| | | | | |
|---|---|---|---|---|
| 3,985,848 | A * | 10/1976 | Frische et al. | 264/504 |
| 6,217,670 | B1 * | 4/2001 | Kacines | 134/32 |
| 2005/0095955 | A1 * | 5/2005 | Mitsuishi et al. | 451/5 |
| 2007/0096347 | A1 | 5/2007 | Bessettes et al. | |

FOREIGN PATENT DOCUMENTS

| | | |
|---|---|---|
| DE | 44 46 616 | 3/1996 |
| DE | 198 49 872 | 5/2000 |
| GB | 2 270 862 | 3/1994 |
| WO | WO 98/25739 | 6/1998 |

* cited by examiner

*Primary Examiner* — Robert Rose
(74) *Attorney, Agent, or Firm* — Weingarten, Schurgin, Gagnebin & Lebovici LLP

(57) ABSTRACT

The invention relates to a method of fabricating a part including at least one face in the form of a surface of revolution from a structure made up of a plurality of thin-walled hollow bodies. In order to ensure that cutting takes place without damaging the walls and/or the bonds between the walls of the hollow bodies, the part is machined in the structure by means of a water jet. More precisely, during machining, the structure is attacked with a jet of water under pressure that is directed tangentially relative to the outer envelope of said at least one face to be made in the form of a surface of revolution.

8 Claims, 8 Drawing Sheets

METHOD OF FABRICATING A PART MADE UP OF A PLURALITY OF THIN-WALLED TUBES AND HAVING A SURFACE OF REVOLUTION

BACKGROUND OF THE INVENTION

The present invention relates to making a three-dimensional part or volume that presents a face in the form of a surface of revolution and that has a structure that is made up of a plurality of cavities separated by walls of small thickness. The invention relates more particularly to machining structures made up of thin-walled hollow bodies in order to make such parts.

The fabrication of such parts, such as for example packing structures for fluid exchange columns, comprises making a structure or a block made up of an assembly of thin-walled hollow bodies (e.g. tubes, honeycomb cells, etc.) and then machining the block to the shape and dimensions required for the final part.

Nevertheless, machining a structure of that type is problematic. Because of the small thickness of the walls, traditional machining tools such as grindwheels or the like are not suitable. The cutting force produced by such tools is too great and leads to the walls being deformed and/or destroyed, thereby preventing the final part from being shaped.

A jet of water under pressure can provide a solution to this problem, since it enables direct contact with the material under attack to be avoided and therefore does not generate a cutting force thereon. Nevertheless, a water jet is mainly used as a tool for cutting solid materials and not hollow bodies. It is known that using a water jet to cut a hollow body is very imprecise and leads to the appearance of large amounts of taper and flash. FIG. 1 shows a structure 10 made up of two juxtaposed tubes 11 and 12 being cut by means of a water jet. The structure is cut by delivering a water jet 2 at high speed from a nozzle 1, the jet initially striking the top portion 12*a* of the wall of tube 12. It can be seen that the jet is deflected and diverges after passing through the top portion 12*a* of the wall of the tube 12. Where the following wall, i.e. the bottom portion 12*b* of the tube 12 will be attacked then becomes imprecise both concerning the position of the cutting and the size thereof. This lack of precision in attack becomes worse as the water jet encounters successive walls, here the top and bottom portions 11*a* and 11*b* of the wall of the tube 11.

As can be seen in FIG. 1, when machining structures made up of thin-walled cavities, each wall that has been passed through acts as a diaphragm for the applied water jet, such that it is impossible to obtain a precise line of cut over all of the successive walls that are to be cut. The direction and the line of cut with a water jet can be under control only when cutting solid materials. In addition, when using a water jet to cut a hollow body, the divergence of the jet leads to it losing energy. The cutting force of the jet can then be insufficient for attacking the following walls, thereby leading to the structure under attack being cut incompletely.

Another solution for machining structures made up of hollow bodies consists in using cutter tools at very high speed. Nevertheless, that type of tool is used essentially for precision machining over small dimensions. Use thereof is not appropriate for machining bodies of revolution of relatively large dimensions, in particular because of the costs involved with that type of tool (frequent replacement of the cutter tools is required).

OBJECT AND SUMMARY OF THE INVENTION

An object of the present invention is to propose a method enabling structures or blocks made up of a plurality of thin-walled hollow bodies to be machined to form parts including at least one face in the form of surface of revolution, and to do so without damaging the walls and/or the connections between the walls of the hollow bodies, while ensuring reliable precision in the cutting of the structure in order to obtain the final shape.

In accordance with the invention, this object is achieved by the fact that the surface of revolution of the part is machined directly in a structure made up of a plurality of thin-walled hollow bodies by using a water jet, the structure being attacked by a water jet under pressure that is directed tangentially relative to the outer envelope of the surface of revolution to be made.

Thus, the fabrication method of the invention provides a solution for using a water jet to machine structures made up of thin-walled hollow bodies while avoiding the problems of cutting imprecision that have been encountered in the past when using a water jet to cut hollow bodies. By attacking the structure with a water jet that is directed tangentially to the outer envelope of the surface of the revolution of the part to be made, the water jet is always directed towards the outside of the shape of the part to be made. Consequently, even if the jet is deflected or diverges beyond its point of attack, the water jet cannot attack material that is to remain in the machined structure, i.e. the volume that is to constitute the surface of revolution of the part to be made.

In addition, by attacking the structure with a jet that is directed tangentially relative to the outer envelope of the surface of revolution to be made, the method of the invention enables the water jet to be used as a genuine machining tool even though a jet is normally used only as a cutting tool. With this orientation of the water jet, it attacks each wall of the structure at a point of cut and not along a line of cut that cannot be controlled after the first wall has been attacked (because of divergence), thereby making it possible to generate accurately the shape that is to be made in the structure. In other words, the method of the invention enables "envelope machining" to be performed, i.e. machining in which it is the point of cut of the water jet that does the work and that constitutes the point generating the desired shape. Envelope machining is normally performed using mechanical cutter tools (e.g. a milling cutter) that do not generate a line of cut, and not using stream-ejection tools, such as a water jet cutter.

In an aspect of the invention, the walls of the hollow bodies present thickness of less than 1 millimeter (mm).

In another aspect of the invention, the structure is made up of a plurality of tubes oriented in a plurality of directions, the tubes being bonded to one another via their portions in contact. The tubes may be made of composite material, or of metal, or of thermoplastic material, or of thermosetting material. When the tubes are made of composite material, they may be in particular be of carbon-carbon, carbon-ceramic, or ceramic material.

The method of the invention can be used for fabricating parts that present, by way of example, an outer envelope forming a cylinder of revolution, and also for parts that present one or more faces in the form of surfaces of revolution.

In order to machine a part having at least one surface of revolution from a structure made up of a plurality of hollow bodies having walls of thickness less than 1 mm, it is possible in particular to use the following parameters:

- water jet pressure at the outlet from the nozzle lying in the range 1500 bars to 5000 bars;
- water pure or abrasive-filled depending on the nature of the material of the walls to be attacked;

cutting speed lying in the range 0.8 meters per minute (m/min) to 1.5 m/min; and nozzle diameter lying in the range 0.1 mm to 2 mm.

BRIEF DESCRIPTION OF THE DRAWINGS

Other characteristics and advantages of the invention appear from the following description of particular embodiments of the invention given as non-limiting examples, with reference to the accompanying drawings, in which.

DETAILED DESCRIPTION OF AN EMBODIMENT

The present invention applies to machining shapes forming surfaces of revolution in structures or blocks that are made up of thin-walled hollow bodies, such as tubes or honeycombs, for example. The term "thin-walled" is used herein to mean walls presenting a thickness of less than 1 mm. The surfaces of revolution to be obtained may relate solely to a portion of the part, e.g. a single face thereof, or else to the entire outer periphery of the part.

With reference to FIGS. 2 to 6, there follows a description of a method of fabricating a part in accordance with an implementation of the invention. More precisely, in this implementation, the method of the invention is used to make a part of cylindrical shape from a block made up of an assembly of tubes. By way of example, the part that is to be made may be for forming a packing element in a fluid exchange column.

Figure 1:
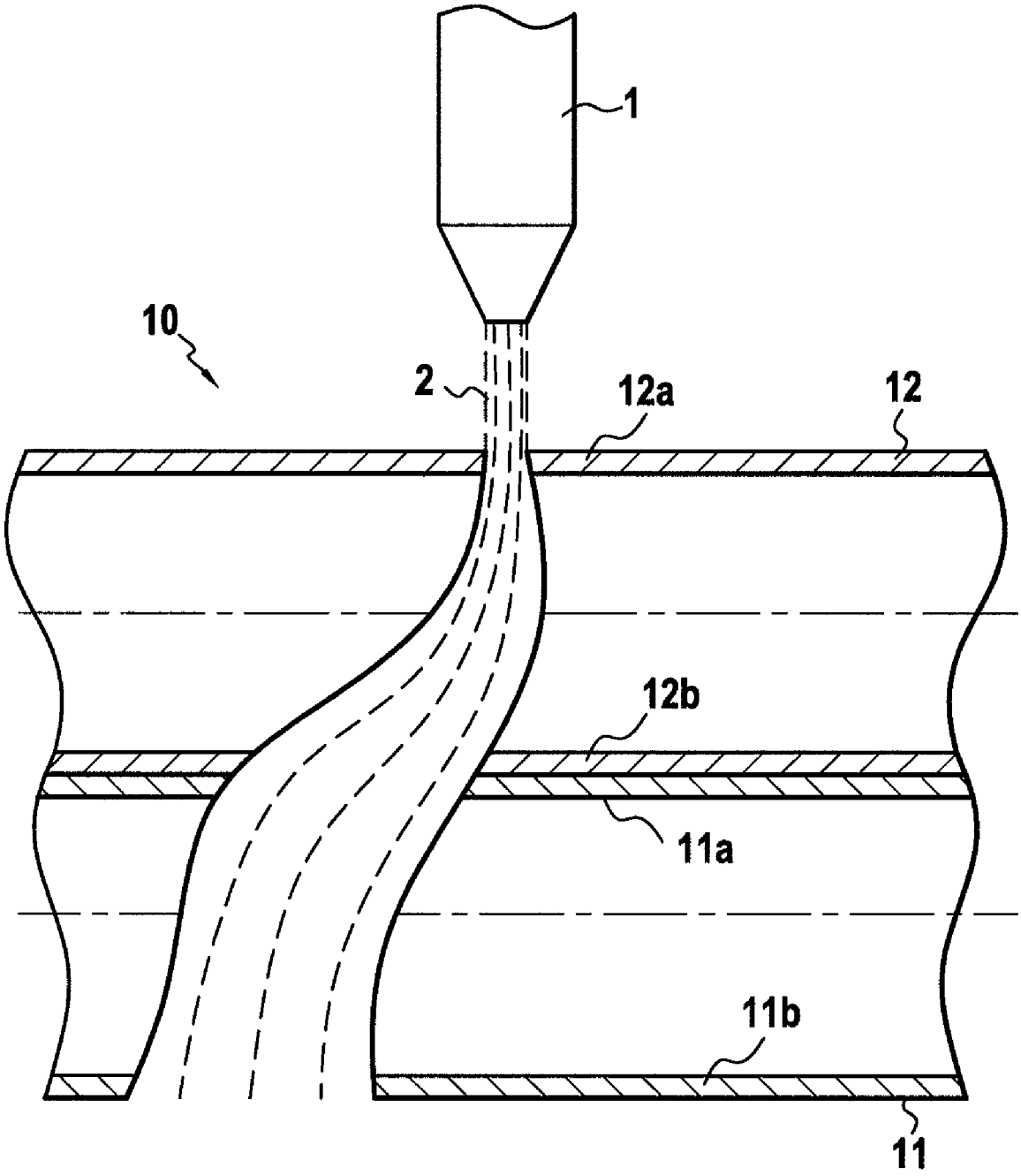
FIG. 1, described above, is a diagram showing how a water jet under pressure is detected and dispersed while cutting through a plurality of walls simultaneously.
Figure 2:
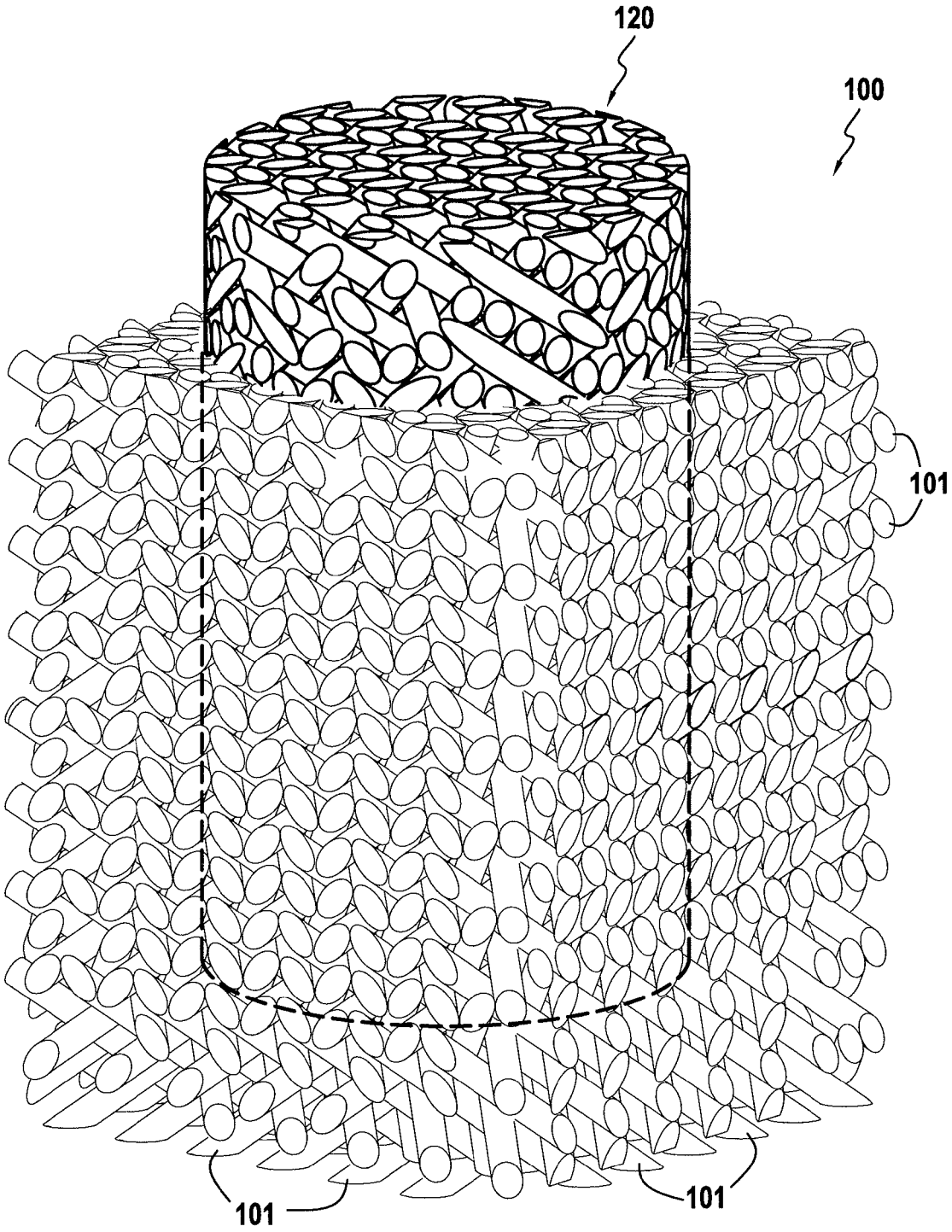
FIG. 2 is a perspective view of a blank for machining that is constituted by an ordered assembly of tubes.

As shown in FIG. 2, it is desired to make a final part 120 from a substantially rectangular block 100 constituted by an ordered assembly of tubes 101 oriented in four distinct directions. The technique for constructing such a block is described in detail in documents U.S. Pat. No. 4,168,337 and US 2007/0096347.

The tubes 101 may be made of composite material such as carbon or ceramic (SiC), or they may be made of a metal, thermoplastic, or thermosetting material. The tubes preferably present a wall thickness that is as thin as possible, and in any event less than 1 mm.

With tubes made of composite material (e.g. carbon or SiC tubes), the tubes may be formed by way of example from braids, filamentary windings, wound tapes, or from tubes possibly made by pultrusion, that are kept in shape on a support rod and consolidated by a liquid technique, i.e. by impregnating the braid with a resin suitable for infiltrating and for coking, such as phenolic resin, and by curing the resin by heat treatment. The walls of the tubes may also include multiple openings or perforations.

In the present example, the tubes are made of a carbon/carbon composite material and they present a wall thickness of about 0.2 mm. Connections between tubes are made solely via the contacting portions of the tubes. Consequently, the block 100 presents a structure that is relatively fragile, both concerning the tubes because of their small wall thickness, and concerning the connections between adjacent tubes.

FIG. 2 shows the shape of a part 120 that is to be extracted from the block 100. In the example described, the block 100 presents initial shape and dimensions that are fairly different from those of the part 120 that is to be made. The method of the invention then comprises prior steps of roughing-out the block 100 so as to approach the final shape of the part that is to be made before beginning tangential machining in accordance with the invention.

Figure 3:
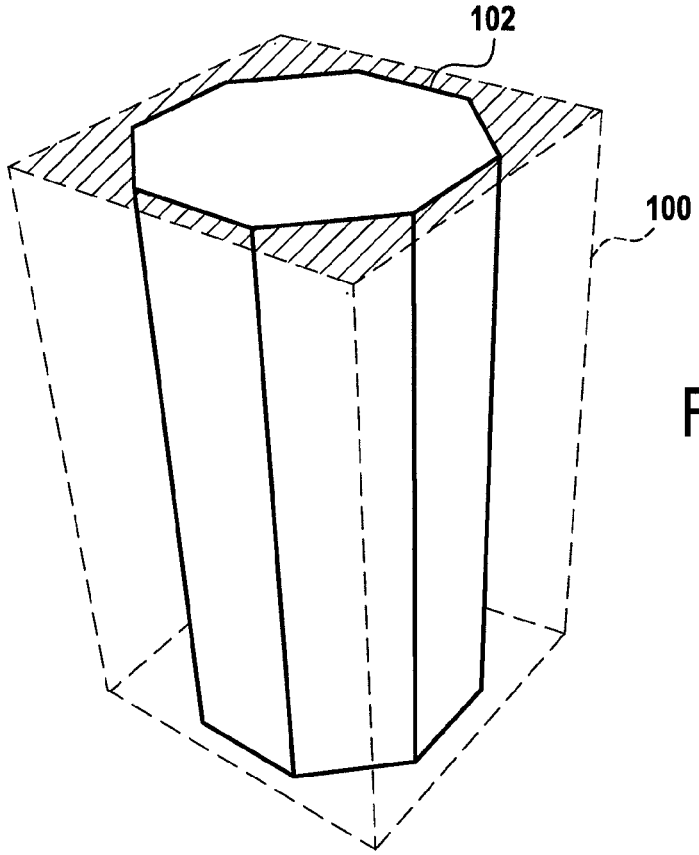
FIGS. 3 and 4 are diagrammatic perspective views showing two successive semi-finished parts made during roughing-out steps performed on the blank of FIG. 2.
Figure 4:
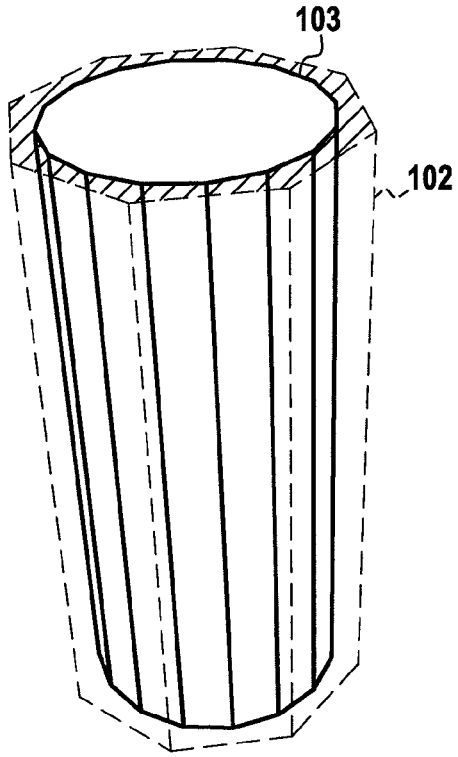

FIG. 3 shows a first roughing-out step in which a first semi-finished part of polygonal section 102 is formed in the block 100. FIG. 4 shows a second roughing-out step in which a second semi-finished part of polygonal section 103 is machined from the previously-machined first semi-finished part 102. The semi-finished part 103 is considered as having a shape and dimensions that are sufficiently close to those of the part that is to be made for it to be possible to proceed with the final machining of the part. The semi-finished parts 102 and 103 can be formed during roughing-out by cutting with a water jet or possibly with high-speed cutter tools such as grindwheels. During the roughing-out step, material is removed at a safe distance from the final shape of the part that is to be made.

In general, the number of roughing-out steps depends on the shape and the dimensions of the starting structure and also on the capabilities of the water-jet machine tool used for the final machining.

Figure 5:
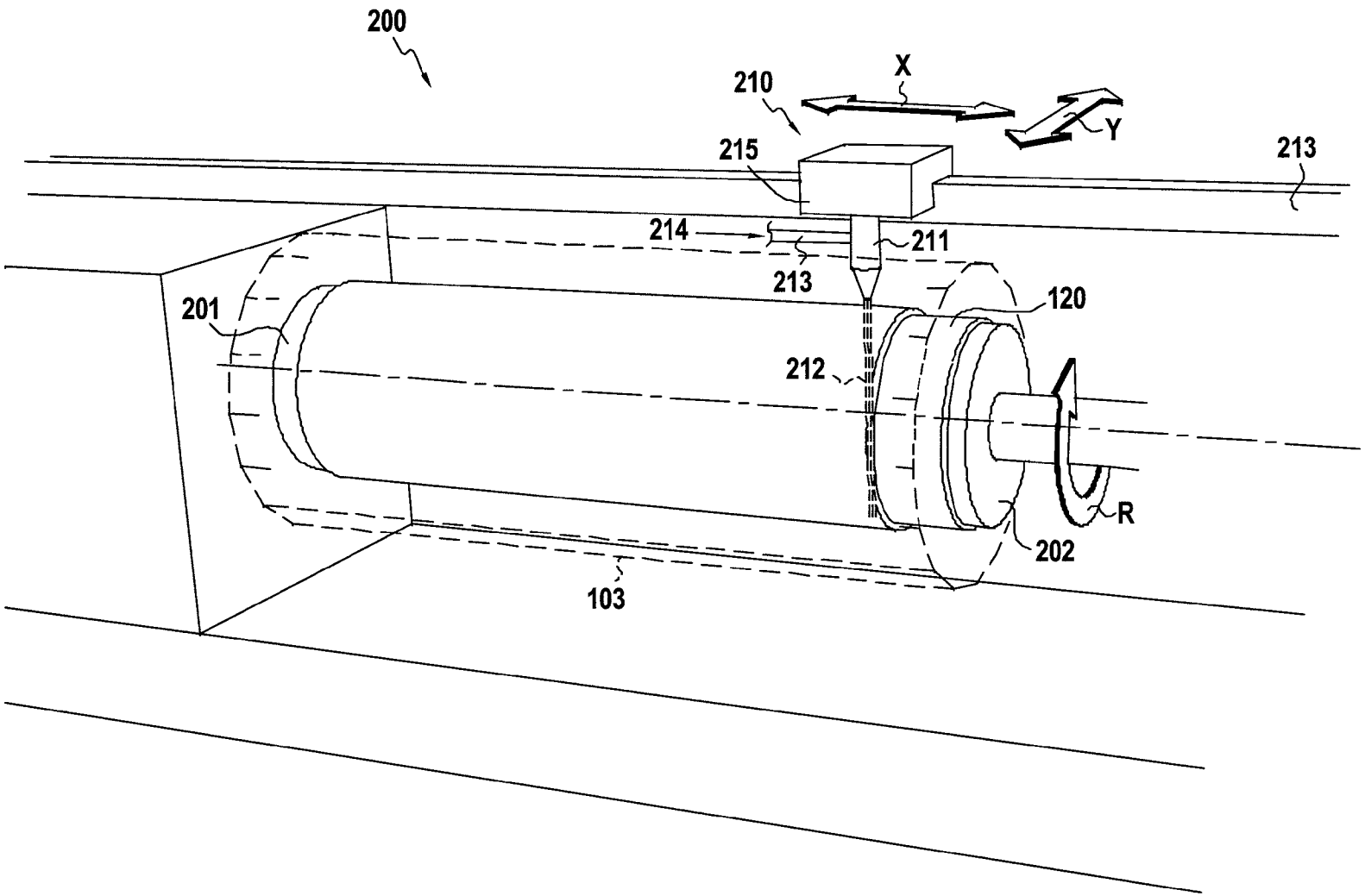
FIG. 5 is a diagrammatic perspective view of a machine tool used for performing the tangential machining in accordance with the invention on a part made up of thin-walled hollow bodies.

Once the roughing-out steps have been finished, i.e. when the roughed-out part presents a shape and dimensions that are sufficiently close to the final part that is to be made for it no longer to be possible to cut through the material without running the risk of damaging the useful material of the final part, the method proceeds with tangential machining of the part that is to be made. For this purpose, and as shown in FIG. 5, the roughed-out part or semi-finished part 103 is placed in a machine tool 200 having a pressurized water-jet cutter head 210 comprising a nozzle 211 mounted on a carriage 215 adapted to move along an X direction on a rail 213, itself movable along a Y direction.

At one end, the roughed-out part 103 is held by a rotary drive chuck 201, and at its other end by a holder support 202 that is free to rotate.

In accordance with the invention, the roughed-out part 103 is attacked with a jet 212 of water under pressure that is directed tangentially relative to the outer envelope of the part 120 to be made. Depending on the nature of the material that is to be machined, it is also possible to incorporate an abrasive 214 via a duct 213 placed upstream from the outlet of the nozzle so as to enable abrasive to be mixed with the water prior to ejection. During a pass, the nozzle 211 moves in the X direction from the end of the part situated beside the holder support 202 to the other end of the part situated beside the chuck 201, and simultaneously the part is driven in rotation in the direction R as shown in FIG. 5. During the following pass, the nozzle 211 is moved in the Y direction towards the inside of the part so as to reposition the jet 212 of water under pressure on the material (the tubes) to be attacked.

Figure 6:
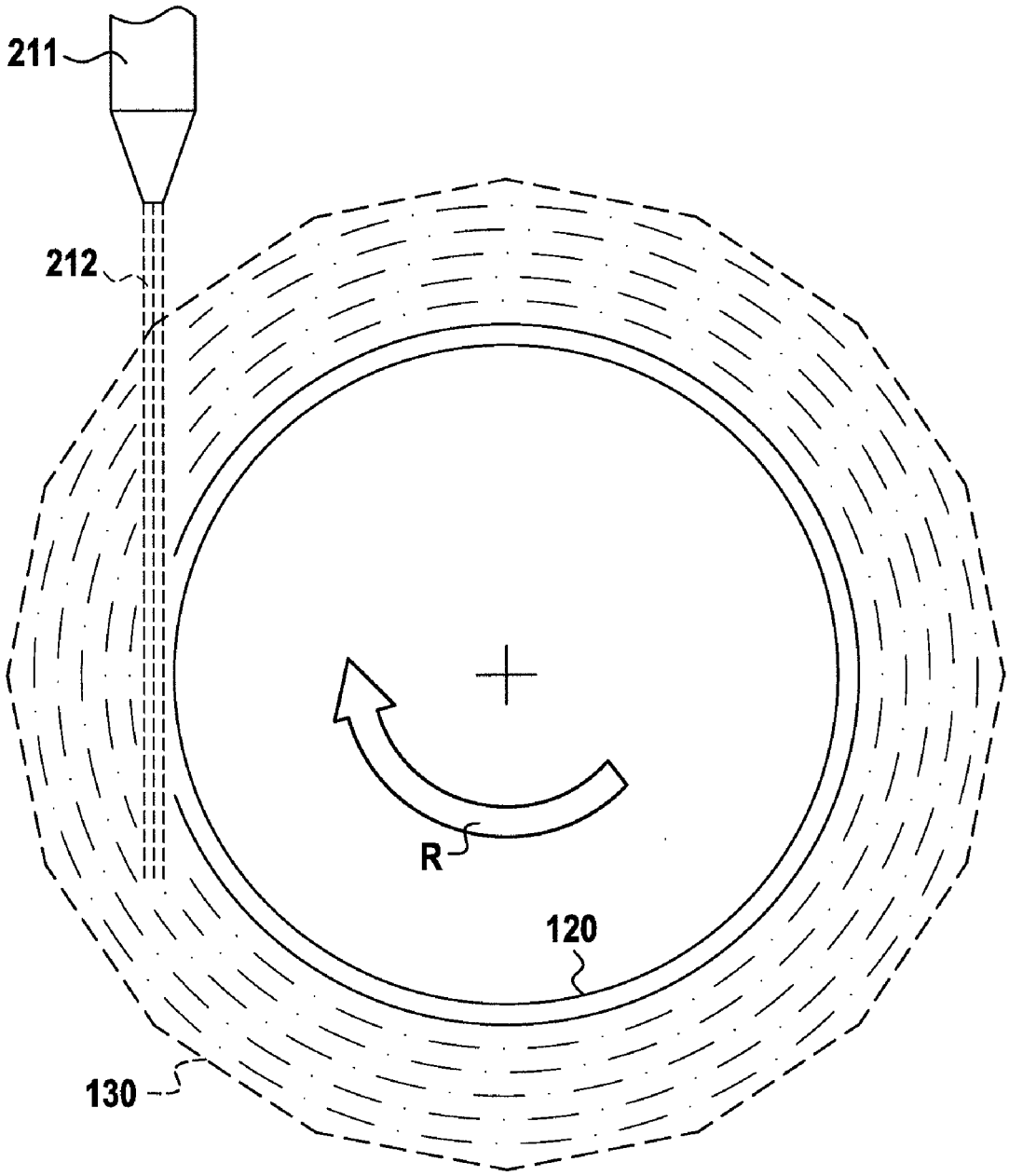
FIGS. 6 and 7 are section views showing the tangential machining performed by the FIG. 5 machine tool.
Figure 7:
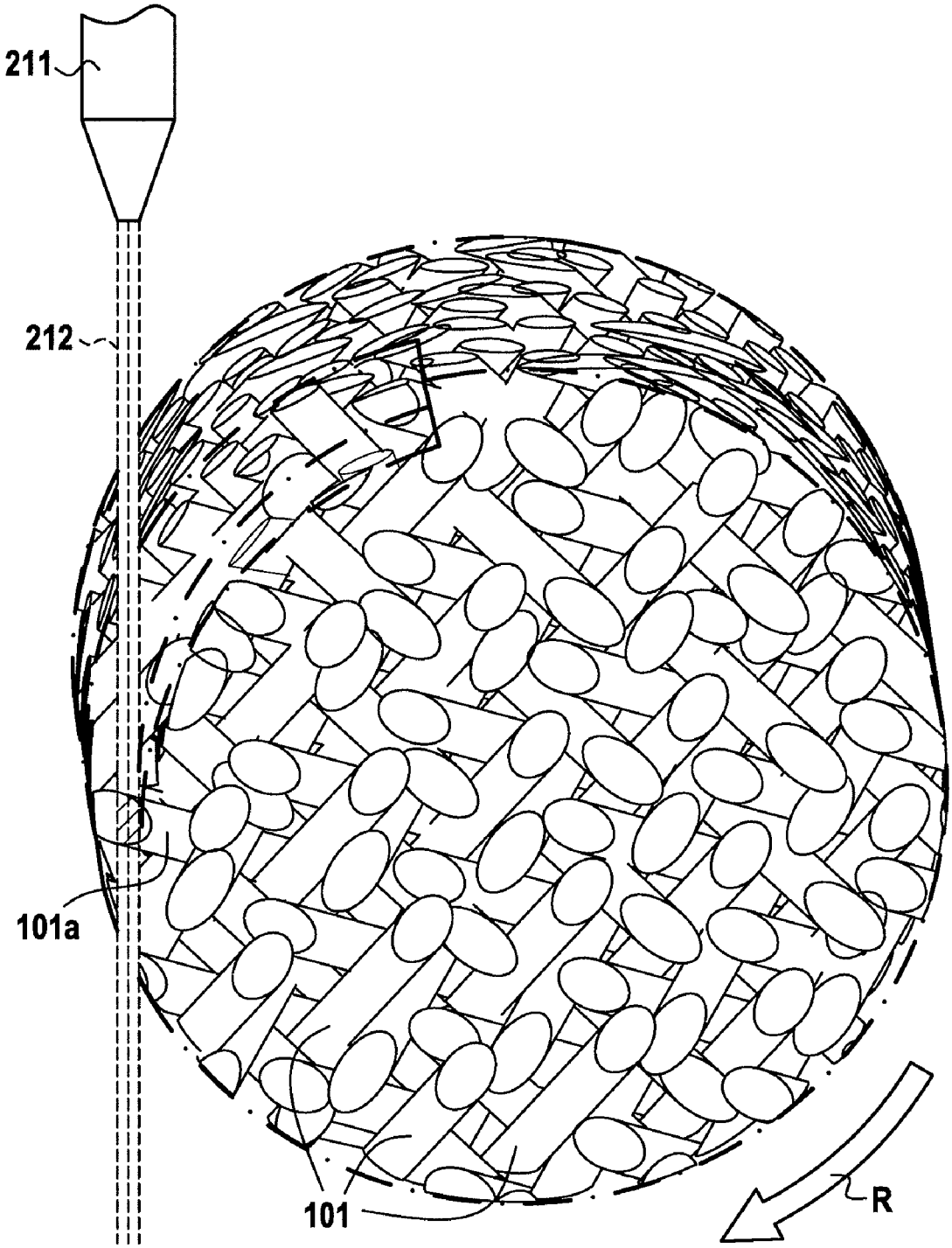

In accordance with the invention, and as shown in FIGS. 6 and 7, the jet 212 of water under pressure attacks the walls of the tubes of the part successively with an attack point that is directed tangentially relative to the envelope of the part 120 that is to be made. In this way, the jet 212 always attacks only one tube 101*a* at a time (FIG. 7) and the walls of the tube situated after the wall of the tube subjected to the initial attack lie outside the envelope of the final part 120 that is to be made.

The number of passes depends mainly on the thickness of material that is to be removed, as a function of the depth of each pass.

Figure 8:
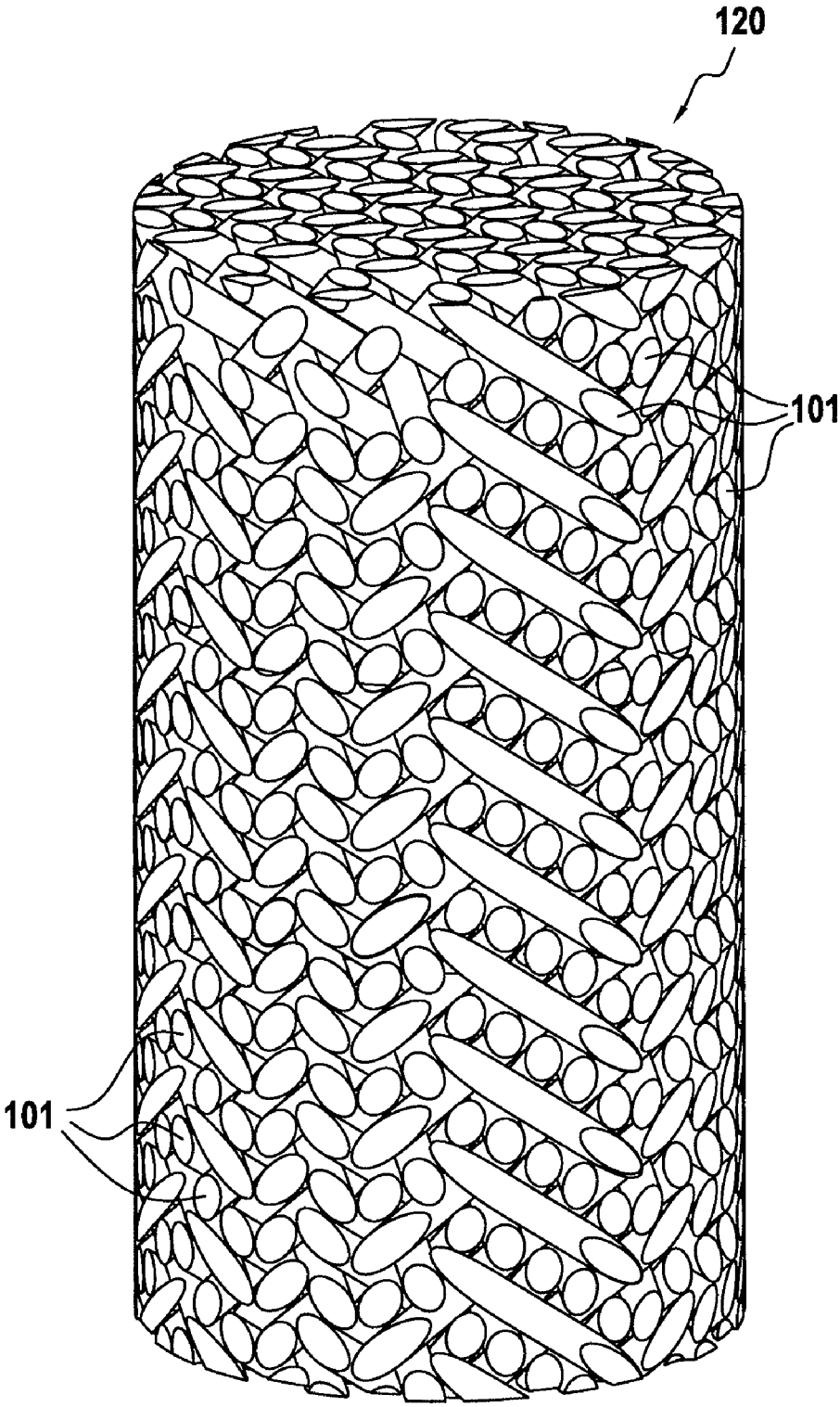
FIG. 8 is a perspective view of a cylindrical part obtained in accordance with the fabrication method of the invention.

FIGS. 5 to 7 show the machining operation during the final pass, i.e. after n passes have been performed as represented by dashed lines in FIG. 6, such that the jet 212 of water under pressure attacks the walls of the tubes closest to the outer envelope of the part 120 that is to be machined for a last time. Once this last pass has been performed, and as shown in FIG. 8, the final part 120 is obtained that is constituted by a plurality of tubes 101 and that presents a cylindrical shape.

Figure 9:
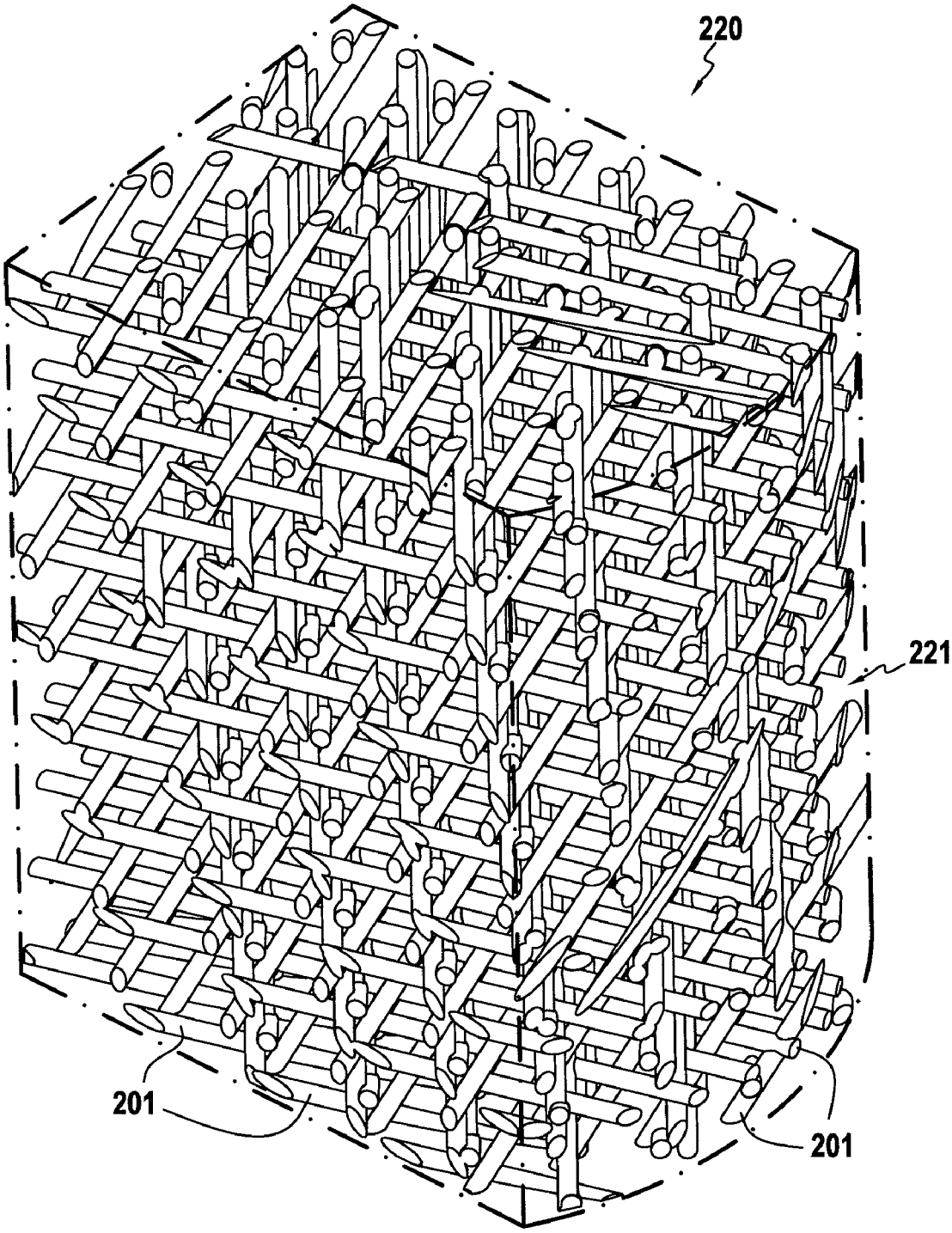
FIG. 9 is a perspective view of another part having a face forming a surface of revolution that is likewise obtained in accordance with the fabrication method of the invention.

As described above, the method of the invention can be applied to making parts in the form of bodies of revolution (cylindrical, oval, bullet-shaped, etc.). Nevertheless, the method of the invention can also be implemented for making parts that have one or more faces in the form of surfaces of revolution. FIG. 9 shows a part 220 made up of a plurality of tubes 201 similar to the tubes 101 described above and having faces that are substantially plane with the exception of the face 221 that presents the shape of a surface of revolution. In accordance with the invention, this face 221 is machined in the same manner as that described above for forming the cylindrical wall of the part 120, but with rotation of the part for machining on the machine tool being restricted on each pass so as to attack only that portion of the block that corresponds to the face 221 that is to be made.

As explained above, in the present invention, the hollow body structure can be worked using a point of attack as opposed to a line of cut. Parameters such as the pressure of the jet do not need to be adjusted in order to make it possible to attack a single wall at a time. In order to machine a part including at least one face in the form of a surface of revolution out of a structure made up of a plurality of hollow bodies having walls of wall thickness less than 1 mm, the following parameters are used:

- pressure of the water jet at the outlet from the nozzle lying in the range 1500 bars to 5000 bars;
- water either pure or abrasive-filled depending on the nature of the material of the walls to be attacked;
- cutting speed lying in the range 0.8 m/min to 1.5 m/min; and
- nozzle diameter lying in the range 0.1 mm to 2 mm.

What is claimed is:

1. A method of fabricating a part including at least one face in the form of a surface of revolution from a structure made up of a plurality of thin-walled hollow bodies, wherein the part is machined in said structure by means of a water jet, and wherein, during machining, the structure is attacked with a jet of water under pressure that is directed tangentially relative to the outer envelope of said at least one face to be made in the form of a surface of revolution, wherein the structure is made up of a plurality of tubes oriented in a plurality of directions.

2. A method according to claim 1, wherein the walls of the hollow bodies present thickness of less than 1 mm.

3. A method according to claim 1, wherein the jet of water under pressure is filled with at least one abrasive material.

4. A method according to claim 1, wherein the tubes are bonded together via their portions in contact.

5. A method according to claim 1, wherein the tubes are of composite material, or of metal, or of thermoplastic material, or of thermosetting material.

6. A method according to claim 5, wherein the tubes are of carbon-carbon, carbon-ceramic, or ceramic composite material.

7. A method according to claim 1, wherein the walls of the tubes include a multiplicity of perforations.

8. A method according to claim 1, wherein the part machined in the structure presents an outer envelope constituting a cylinder of revolution.

* * * * *